US011511150B2

(12) United States Patent
Ucgun et al.

(10) Patent No.: US 11,511,150 B2
(45) Date of Patent: Nov. 29, 2022

(54) RAIL SYSTEM IN PILATES EXERCISE DEVICES

(71) Applicant: BASI SYSTEMS PILATES SANAYI TICARET A.S., Istanbul (TR)

(72) Inventors: Mumin Cengiz Han Ucgun, Istanbul (TR); Servet Gulbay, Istanbul (TR)

(73) Assignee: BASI SYSTEMS PILATES SANAYI TICARET A.S., Istanbul (TR)

( * ) Notice: Subject to any disclaimer, the term of this patent is extended or adjusted under 35 U.S.C. 154(b) by 107 days.

(21) Appl. No.: 17/044,330

(22) PCT Filed: Mar. 11, 2019

(86) PCT No.: PCT/TR2019/050151

§ 371 (c)(1),
(2) Date: Oct. 1, 2020

(87) PCT Pub. No.: WO2019/212443

PCT Pub. Date: Nov. 7, 2019

(65) Prior Publication Data

US 2021/0077851 A1 Mar. 18, 2021

(30) Foreign Application Priority Data

Apr. 30, 2018 (TR) ..... 2018/06086
Feb. 5, 2019 (TR) ..... 2019/01678

(51) Int. Cl.
*A63B 21/00* (2006.01)
*A63B 1/00* (2006.01)
(Continued)

(52) U.S. Cl.
CPC ..... *A63B 21/4031* (2015.10); *A63B 1/00* (2013.01); *A63B 22/203* (2013.01);
(Continued)

(58) Field of Classification Search
CPC ..... A63B 1/00; A63B 17/00; A63B 21/00047; A63B 21/00178; A63B 21/00185;
(Continued)

(56) References Cited

U.S. PATENT DOCUMENTS 5,580,340 A 12/1996 Yu
5,624,195 A * 4/1997 Abe ..... F16C 29/084 384/15
8,052,586 B2 * 11/2011 Hahn ..... A63B 17/00 482/142

(Continued)

FOREIGN PATENT DOCUMENTS

CN 207101741 U 3/2018
KR 200474605 Y1 * 9/2014
KR 200474605 Y1 9/2014

*Primary Examiner* — Joshua Lee
(74) *Attorney, Agent, or Firm* — Bayramoglu Law Offices LLC

(57) ABSTRACT

The exercise device of the invention includes a rail carrier body, at least one fixed body in contact with the rail carrier body, at least one rail located on the rail carrier body, at least one movable body located on the rail, at least one adjusting rod located on the upper portion of the movable body and at least one transmission bar which is in contact with the adjusting rod and transmits the rotary motion on the adjusting rod to the fixing pin or rail.

20 Claims, 26 Drawing Sheets

(51) Int. Cl.
*A63B 22/20* (2006.01)
*A63B 69/00* (2006.01)

(52) U.S. Cl.
CPC ..... *A63B 69/0057* (2013.01); *A63B 21/4029* (2015.10); *A63B 22/201* (2013.01); *A63B 2225/09* (2013.01)

(58) Field of Classification Search
CPC ..... A63B 21/4023; A63B 21/4029; A63B 21/4031; A63B 21/4033; A63B 21/4034; A63B 21/4035; A63B 21/4037; A63B 21/4039; A63B 22/20; A63B 22/201; A63B 22/203; A63B 2023/006; A63B 23/02; A63B 69/0057; F16C 29/00; F16C 29/084
See application file for complete search history.

(56) References Cited

U.S. PATENT DOCUMENTS

| | | | | |
|---|---|---|---|---|
| 8,172,736 | B2 * | 5/2012 | Contreras | A63B 21/4009 482/142 |
| D763,371 | S * | 8/2016 | Fitzgerald | D21/686 |
| 9,782,622 | B2 * | 10/2017 | Hornback | A63B 23/0482 |
| 10,974,096 | B2 * | 4/2021 | Simmons | A63B 23/0405 |
| 2005/0113226 | A1 * | 5/2005 | Endelman | A63B 22/001 482/130 |
| 2008/0004167 | A1 * | 1/2008 | Endelman | A63B 21/4037 482/142 |
| 2009/0264265 | A1 * | 10/2009 | Contreras | A63B 21/4009 482/99 |
| 2010/0179038 | A1 * | 7/2010 | Hahn | A63B 17/00 482/142 |
| 2019/0022454 | A1 | 1/2019 | Zhou | |

* cited by examiner

RAIL SYSTEM IN PILATES EXERCISE DEVICES

CROSS REFERENCE TO THE RELATED APPLICATIONS

This application is the national phase entry of International Application No. PCT/TR2019/050151, filed on Mar. 11, 2019, which is based upon and claims priority to Turkish Patent Application No. 2018/06086, filed on Apr. 30, 2018, and Turkish Patent Application No. 2019/01678, filed on Feb. 5, 2019, the entire contents of which are incorporated herein by reference.

TECHNICAL FIELD

The invention relates to a spring adjustment system in the seating or resting mechanism moved horizontally in the pilates devices. The invention, in particular, relates to a mechanism having a circular surface on the one side, known as "ladder barrel" in the literature of the pilates exercise equipment and a holding bar on the other side, and connected to a single body in the lower portion. In this mechanism, the adjusting and fixing systems on the rail mechanism of the body, the upper portion of which has a circular surface, have a different configuration than the prior art.

This invention also includes an additional improvement related to the application of the rail movement system in the exercise devices known as "chair" in the pilates exercise devices on the market but at the same time named as "chair barrel".

BACKGROUND

Both sports and psychotherapeutic exercise equipment have a relatively different construction and are common in the world. These are the devices which were firstly derived from physical therapy in pilates exercise equipment and subsequently developed for both physical therapy and sports or in order to exercise in a healthy way. Pilates exercise equipment have many different configuration ways according to many movement types. This configuration has a construction including a rod or beam located on a leg known as "barrel ladder" in the relevant sector, one of them having a wide and half circular top surface and the other one being located horizontally on two bars right next to it. It is possible to exercise different types of moves for the person who does pilates by sitting on or abutting against this mechanism, holding the other horizontal bar or getting support somehow.

These pilates devices, known as "ladder barrel" in the prior art, generally comprises a body, the body having a wide and half circular upper portion (half cylindrical body) and another horizontal beam parallel with it. This upper half circular body and the adjacent beam are fixedly mounted to each other. Alternatively, the half circular body (half cylindrical body) in the lower portion is engaged with the body by a rail mechanism and this connection is made fixed (rigid) or movable by a mechanism adjusted from the bottom. In order to adjust this mechanism the user displaces the fixing pins present on the rail at the bottom and edge by bending down and then makes them rigid by sliding the pins over the rail and fitting them in their place. In this way one adjustment, of course, meets the need. However, it is quite difficult for someone to make this adjustment as both hands must be used for the adjustment while bending down.

There is exercise equipment known as "chair barrel" in the state of the art. In order to adjust this type of pilates equipment the user displaces the fixing pins present on the rail at the bottom and the edge by bending down as in the "ladder barrel" type of pilates equipment and then makes them rigid by sliding the pins over the rail and fitting them in their place. In this way one adjustment, of course, meets the need. However, it is quite difficult for someone to make this adjustment as both hands must be used for the adjustment while bending down.

In the state of the art U.S. Pat. No. 8,052,586 to Hard Wood Inc.—an American company—discloses that the movement of a half cylindrical body in the ladder barrel type pilates device is inherently carried out on the rail mechanism, but a rotating shaft is extended through the edge of the exercise device in order to be fixed on the rail mechanism of the body if desired. This rotating shaft is rotated by a rod on the edge of the exercise device, the rail mechanism is clamped and loosened.

SUMMARY

The main object of the invention is to provide a mechanism, which allows the user to adjust the body having a half cylindrical upper surface in the pilates exercise devices based on ladder barrel principle alone without too much bending, capable of being adjusted from the upper portion and providing rigidity by transferring the movement towards the lower portions is intended.

An advantage of said exercise device according to the invention is that a structure which is capable of being adjusted from the upper portion allowing the user to adjust by bending slightly instead of being adjusted by bending on the lower portion provided in the "ladder barrel" type of the pilates devices in the state of the art, and cooperates with a novel rail system is obtained.

Another advantage of said exercise devices according to the invention is that a structure, which is capable of being adjusted from the upper portion in the same manner by adapting the system to the "chair" type of the pilates devices, and cooperates with a novel rail system, is obtained. This structure is a practically adjustable and horizontally slidable "chair" type pilates mechanism which may be also named as a "chair barrel".

In order to better understand the construction of said pilates exercise devices, the reference will be made to the figures.

Figure 1:
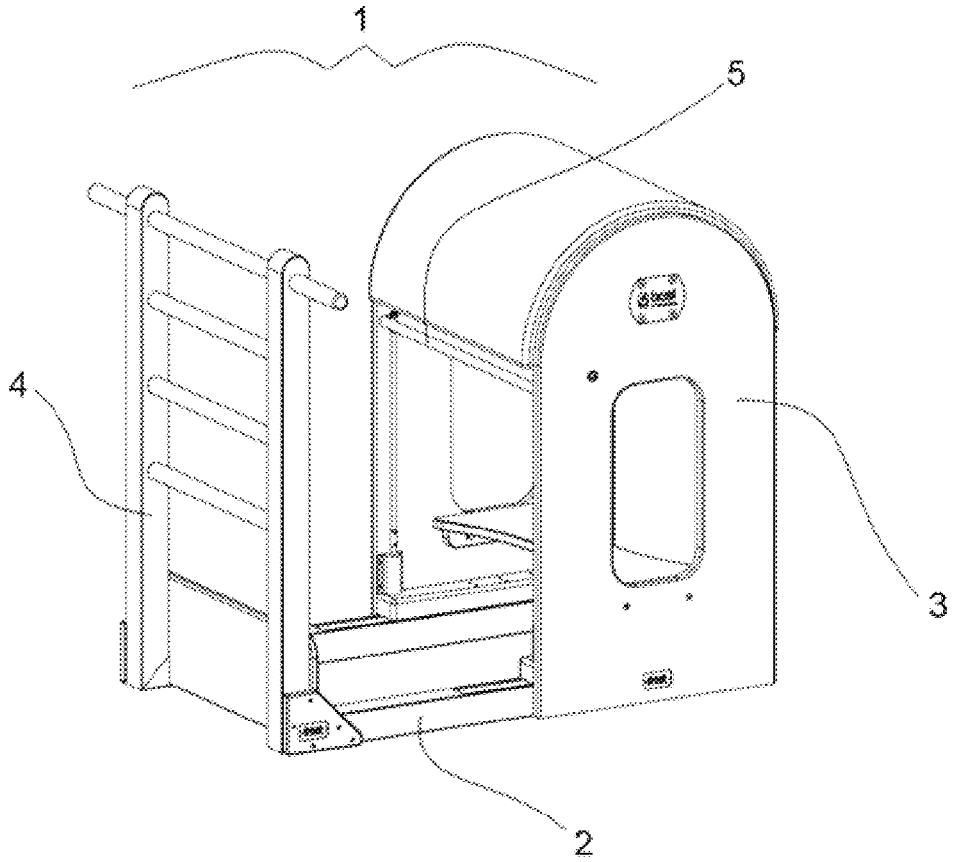
FIG. 1 is the side perspective view of said ladder barrel type pilates exercise device of the invention.
Figure 2:
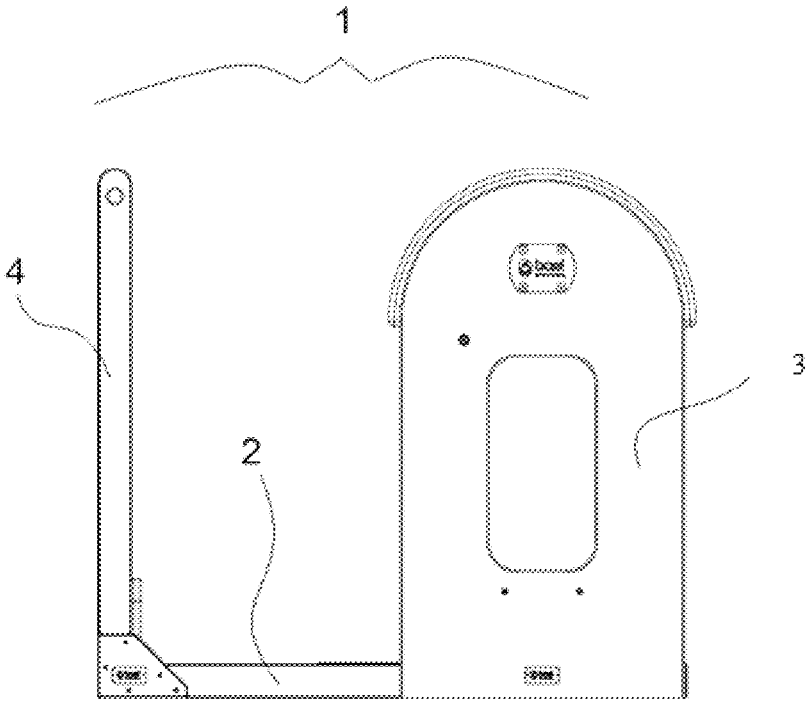
FIG. 2 is the side projective two dimensional view of said ladder barrel type pilates exercise device of the invention.
Figure 3:
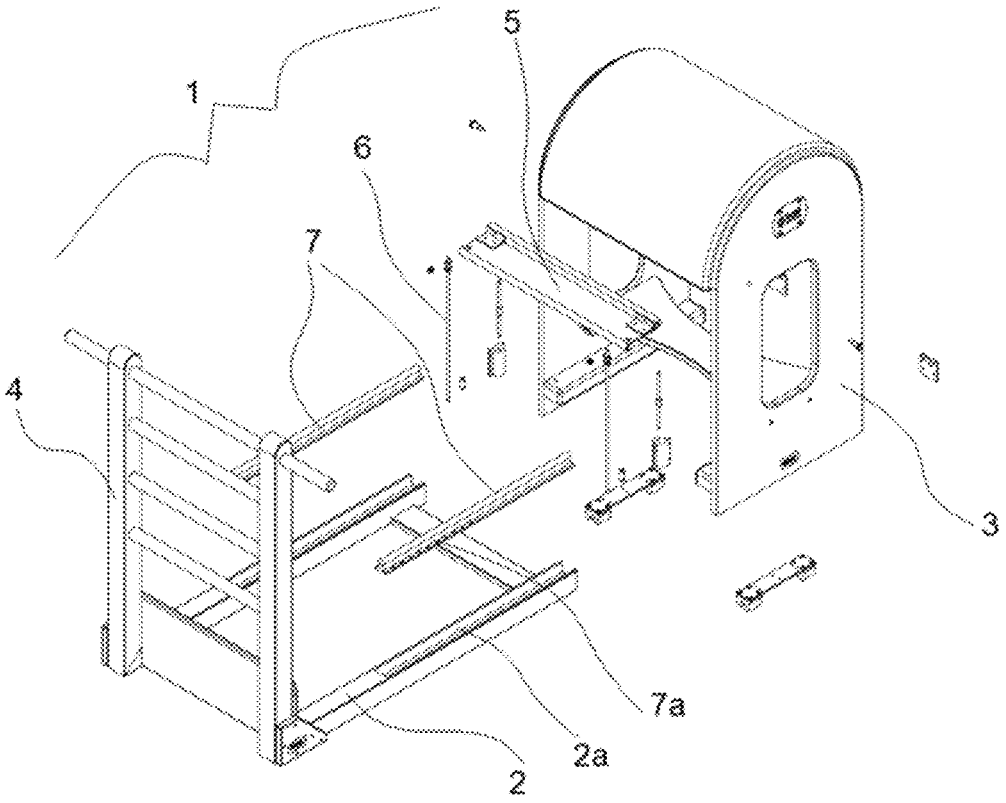
FIG. 3 is an exploded view including the side perspective view of said ladder barrel type pilates exercise device of the invention.
Figure 4:
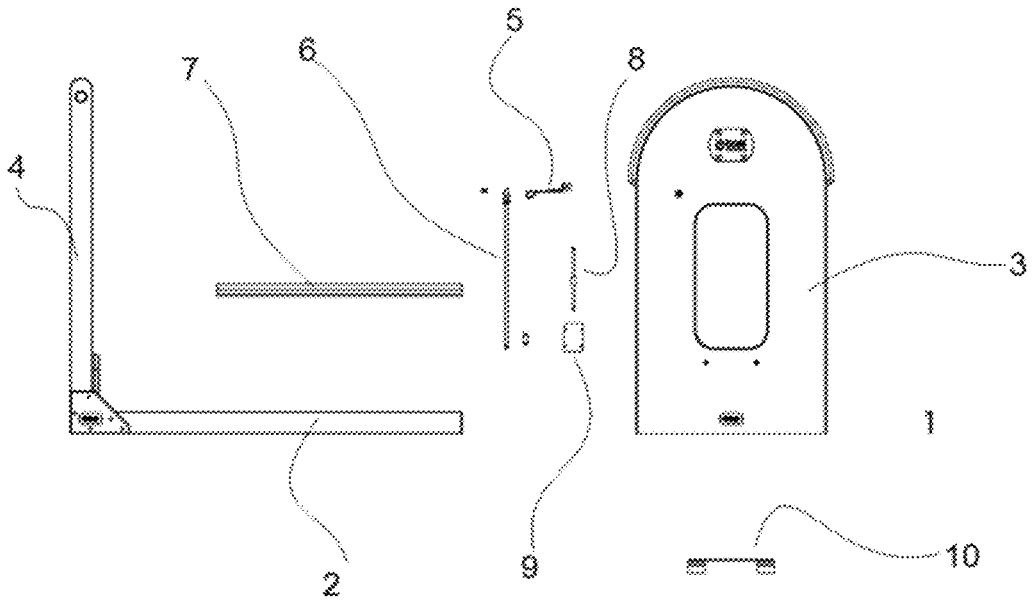
FIG. 4 is an exploded view including the side projective view of said ladder barrel type pilates exercise device of the invention.
Figure 5:
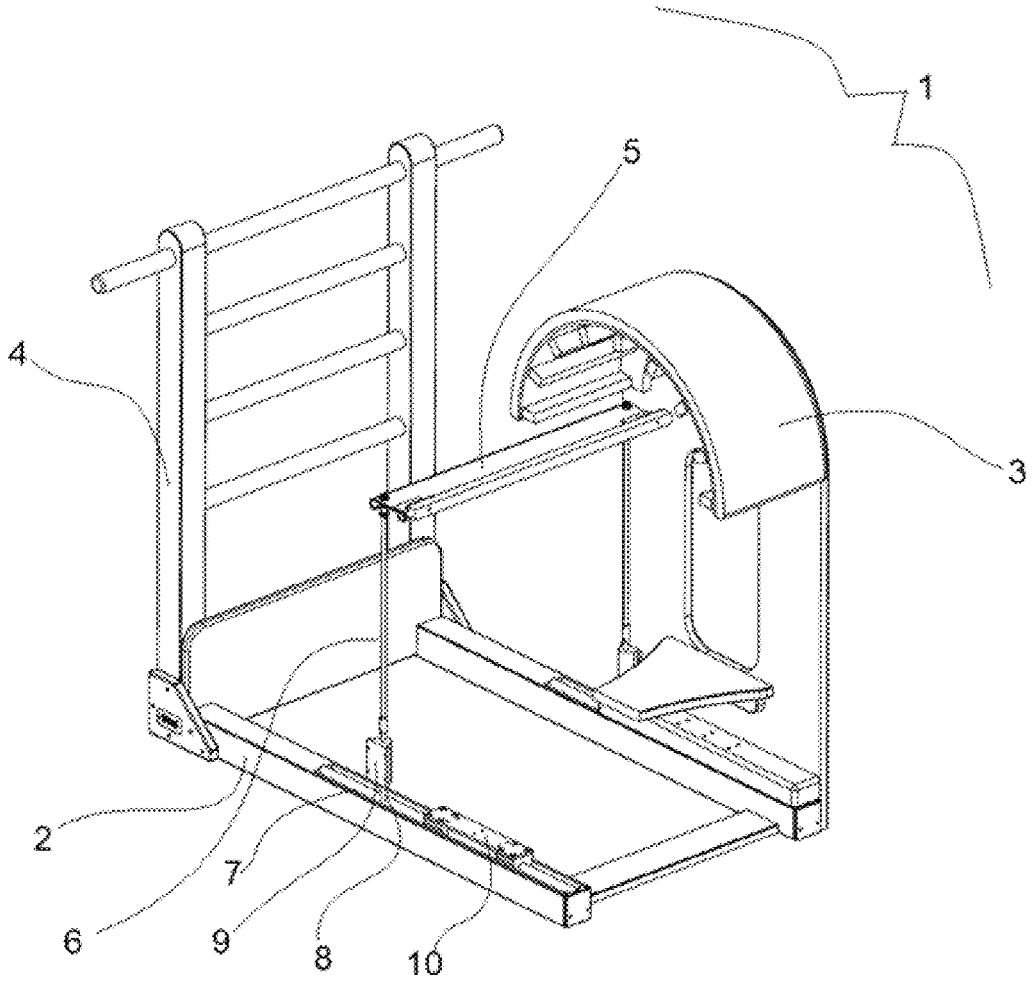
FIG. 5 shows the partial sectional perspective view of said ladder barrel type pilates exercise device of the invention.
Figure 6:
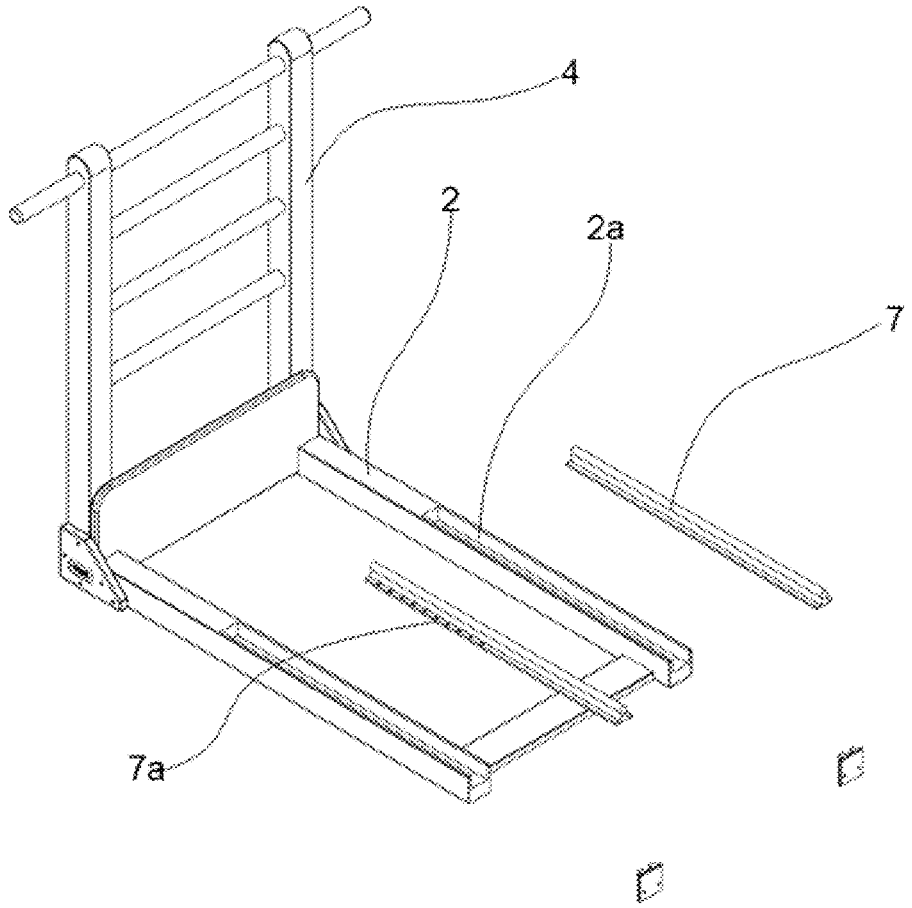
FIG. 6 shows the perspective view of the carrier rail system in said ladder barrel type pilates exercise device of the invention.
Figure 7:
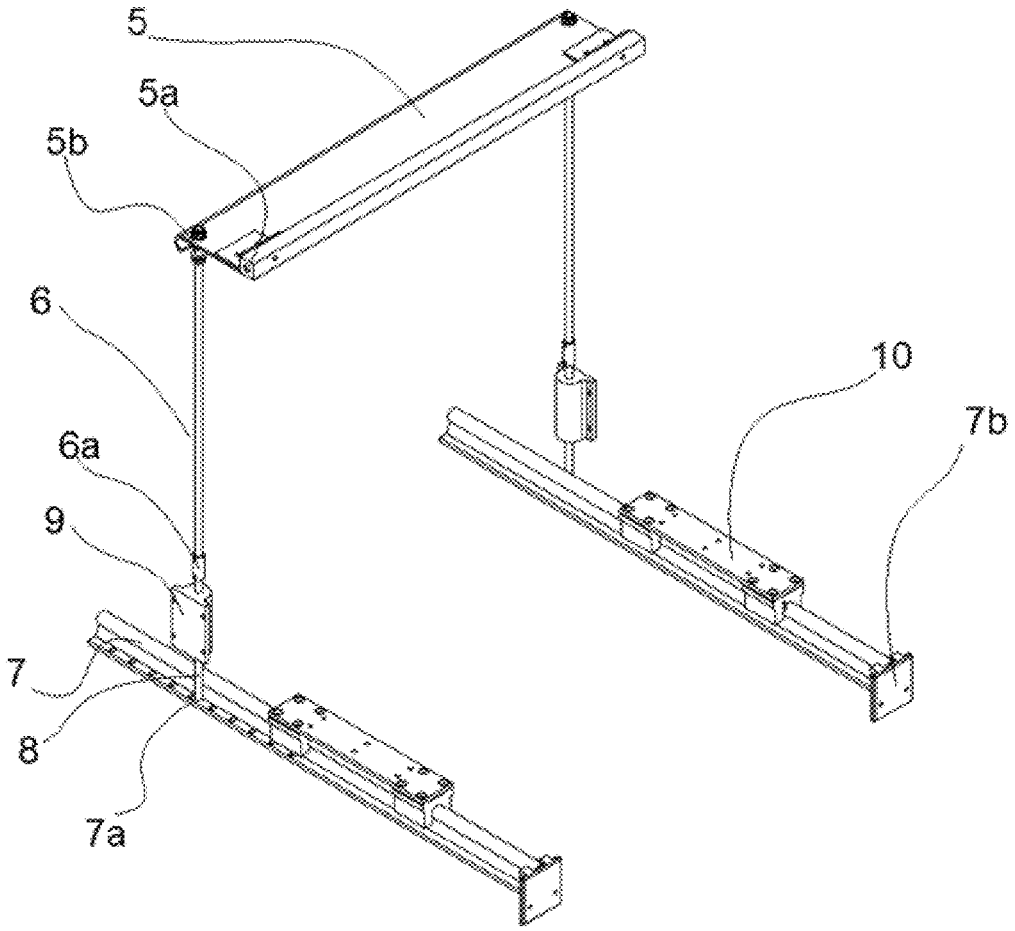
FIG. 7 is the perspective view of the rail and adjusting mechanism used in said ladder barrel type pilates exercise device of the invention.
Figure 8:
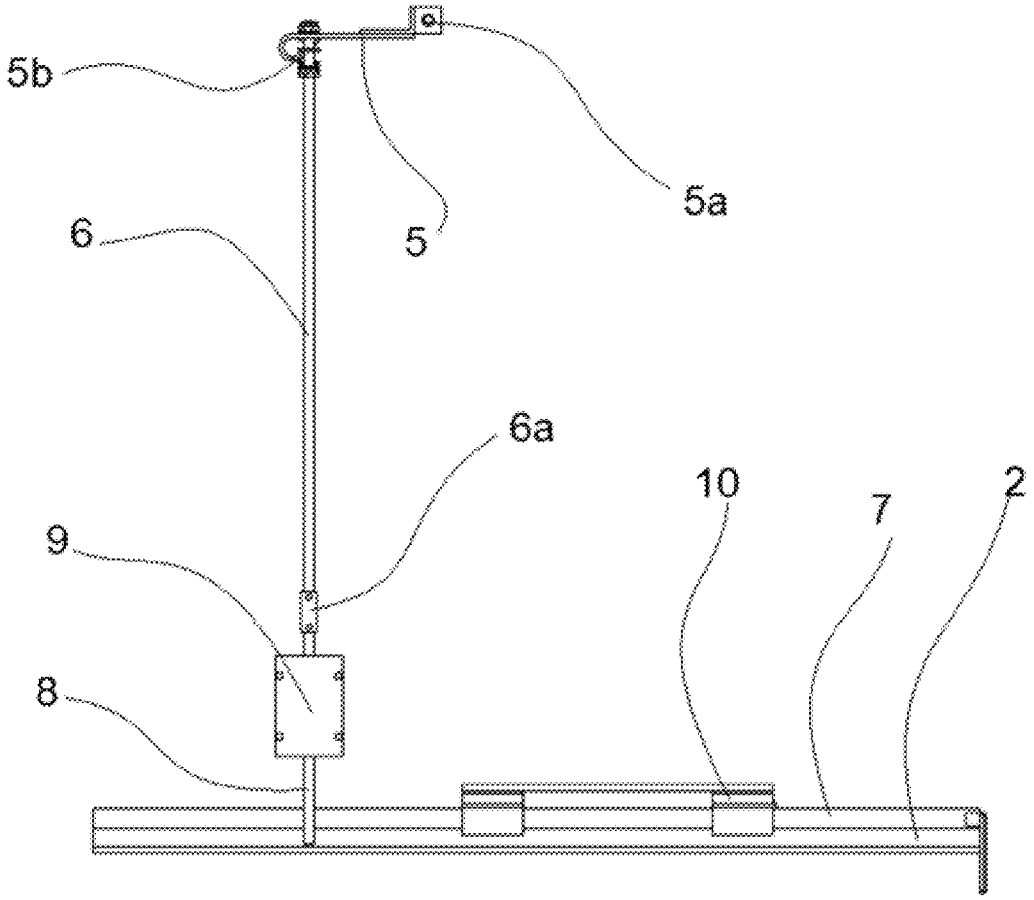
FIG. 8 is the side projective view of the rail and adjusting mechanism used in the said ladder barrel type pilates exercise device of the invention.
Figure 9:
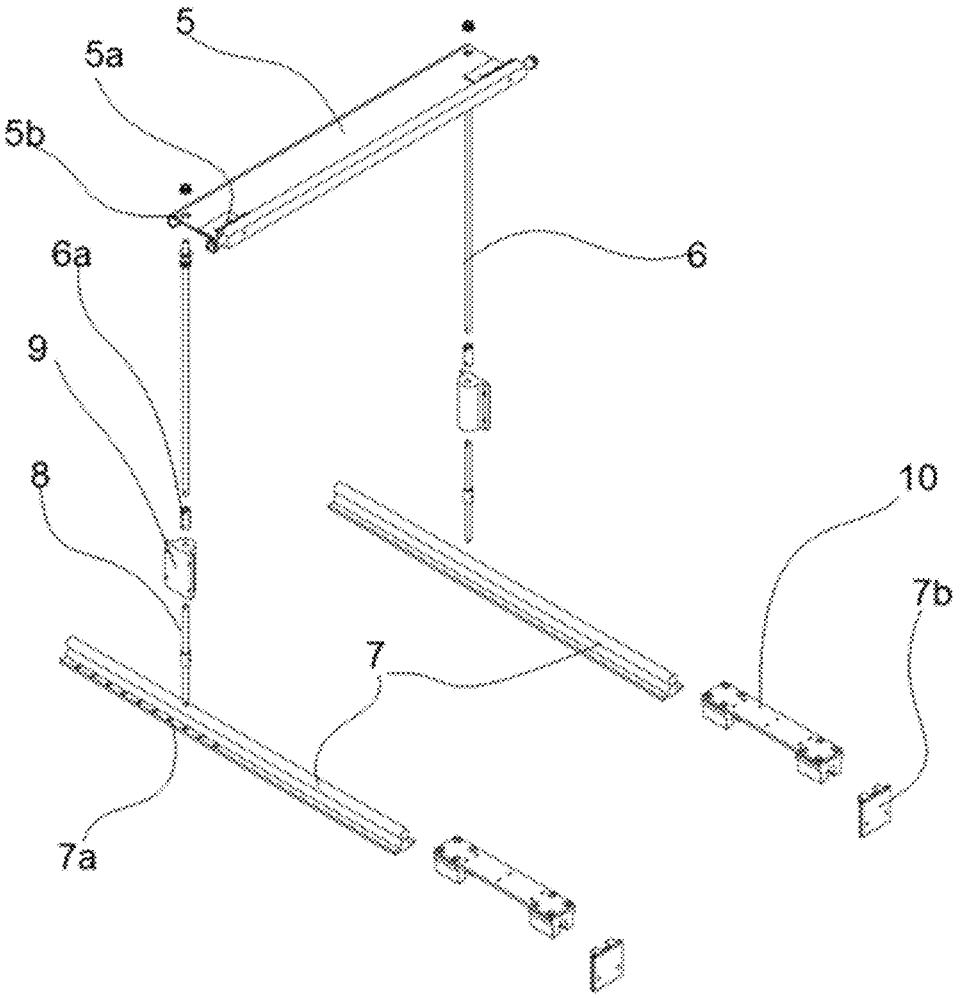
FIG. 9 is the side exploded perspective view of the rail and adjusting mechanism used in the said ladder barrel type pilates exercise device of the invention.
Figure 10:
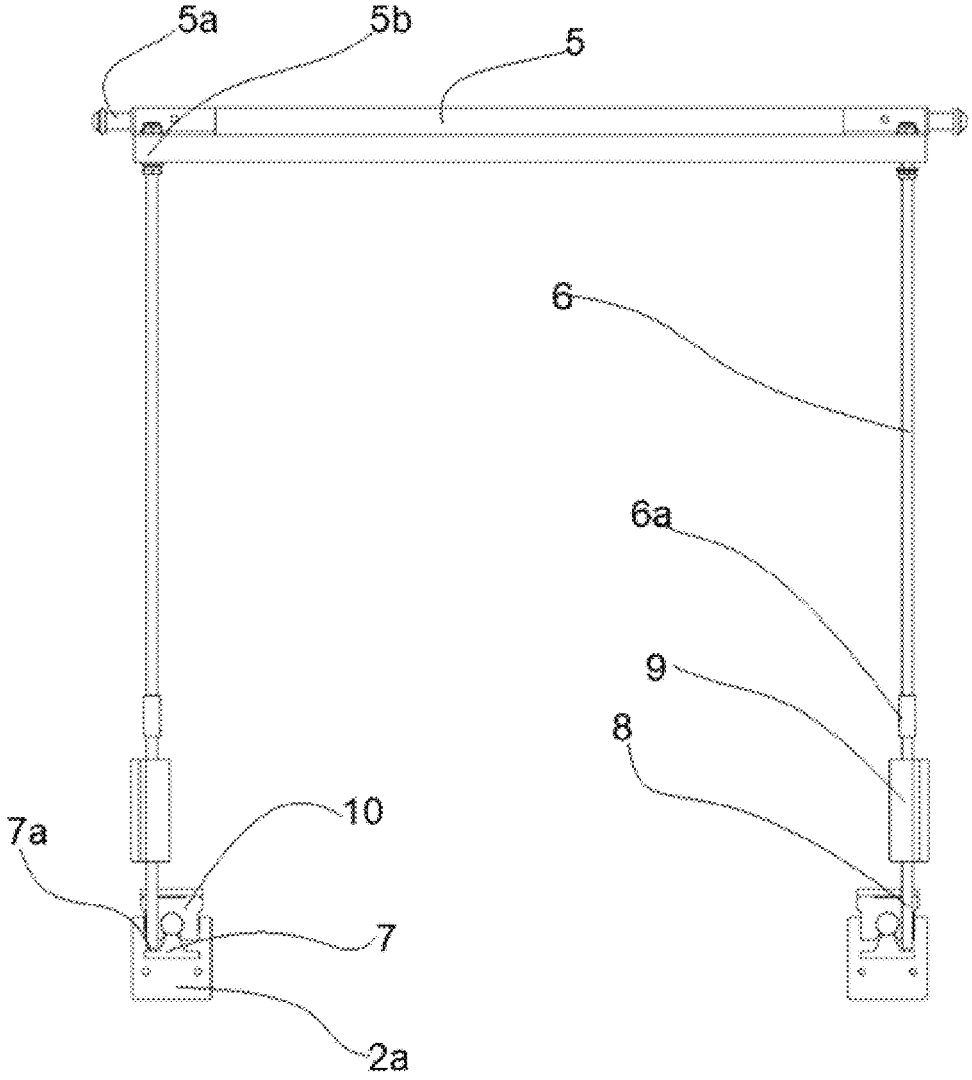
FIG. 10 is the front projective view of the rail and adjusting mechanism used in the said ladder barrel type pilates exercise device of the invention.
Figure 11:
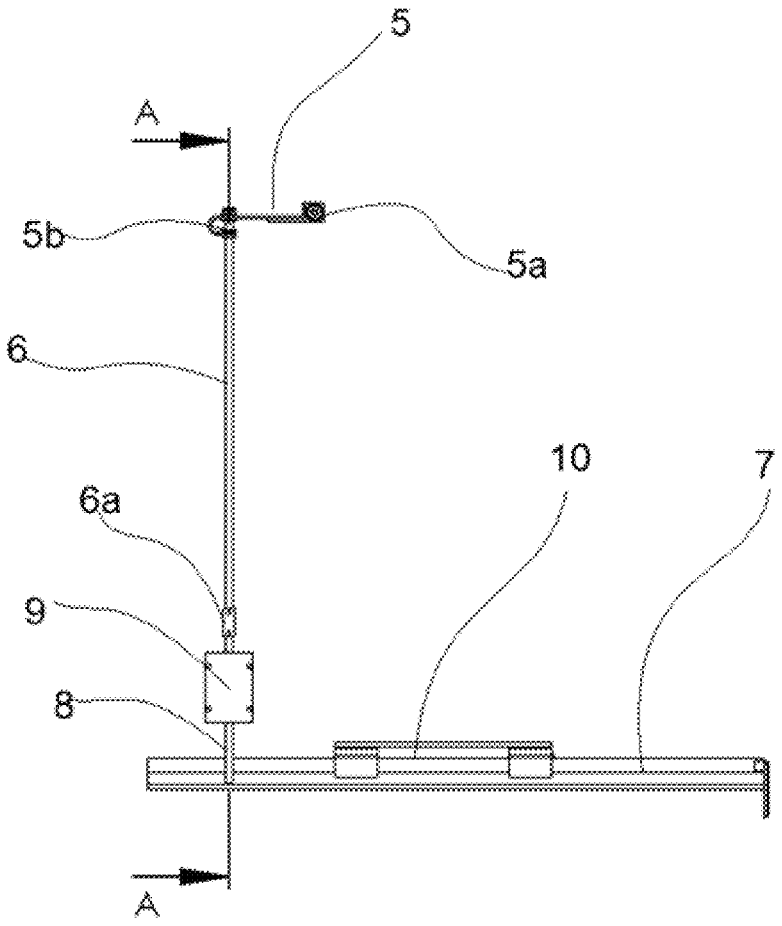
FIG. 11 is the side two dimensional projective view of the rail and adjusting mechanism used in the said ladder barrel type pilates exercise device of the invention.

REFERENCE NUMERALS OF THE PARTS AND SECTIONS TO SERVE FOR THE DESCRIPTION OF THE INVENTION

1—Exercise device
2—Rail carrier body
2*a*—Rail slot
3—Movable body
4—Fixed body
5—Adjusting rod
5*a*—Adjusting rod connection
5*b*—Bar connection
6—Movement transmission bar
6*a*—Connection
7—Rail
7*a*—Fixing hole
7*b*—Stopper
8—Fixing pin
9—Pin slot
10—Carrier
11—Movable assembly
12—Adjusting press rod
13—Deflector
14—Force transmission bar
15—Side connection
16—Side pin slot
17—Small adjusting pin
18—Side support part
19—Movable assembly carrier
20—Seated exercise device

DETAILED DESCRIPTION OF THE EMBODIMENTS

In the exercise device of the invention, the mechanism in the movable connection with the body on the lower portion of the pilates exercise device, mainly known as "ladder barrel" and in which only one person can easily adjust the horizontal movement amount of the movable body with a wide and half circular (half cylindrical body) upper portion, is intended. This adjusting operation different from the state of the art is intended to be easily carried out on the upper portion but not on the lower portion (in which the rails are present) without exhausting the user. Therefore, the following disclosure will be based on a "ladder barrel" type pilates exercise device. However, it is obvious that the main system will be maintained in the similar exercise devices and is not limited to the figures given in the disclosure.

A further improvement in the exercise device of the invention is a structure which is constructed by the combination with the structure known as "barrel" on the market through the application of the rail mechanism to the pilates exercise device known as "Chair" on the market, and may also be named as "chair barrel". The detail of this structure, named as "chair barrel", will be stated as a second alternative engineering design after the following disclosure.

Figure 12:
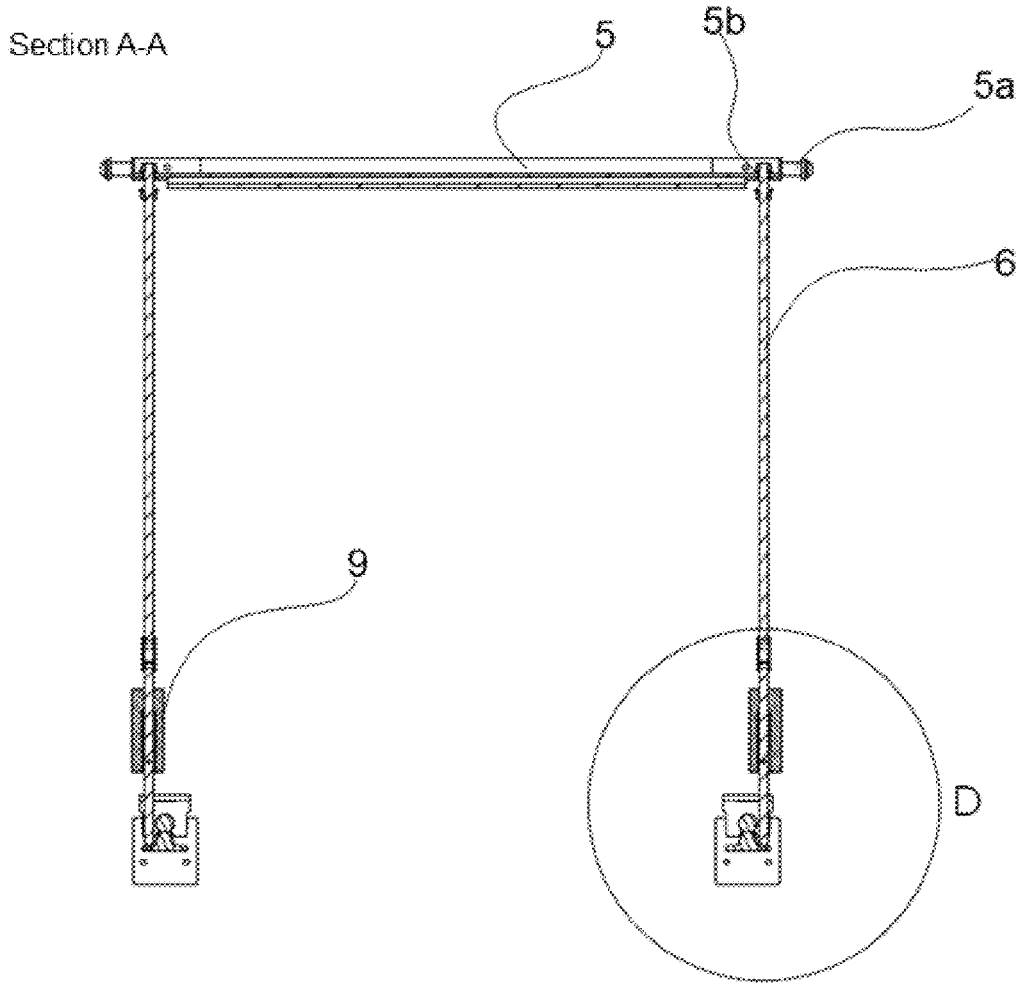
FIG. 12 is the front sectional projective view of the rail and adjusting mechanism used in the said ladder barrel type pilates exercise device of the invention.
Figure 13:
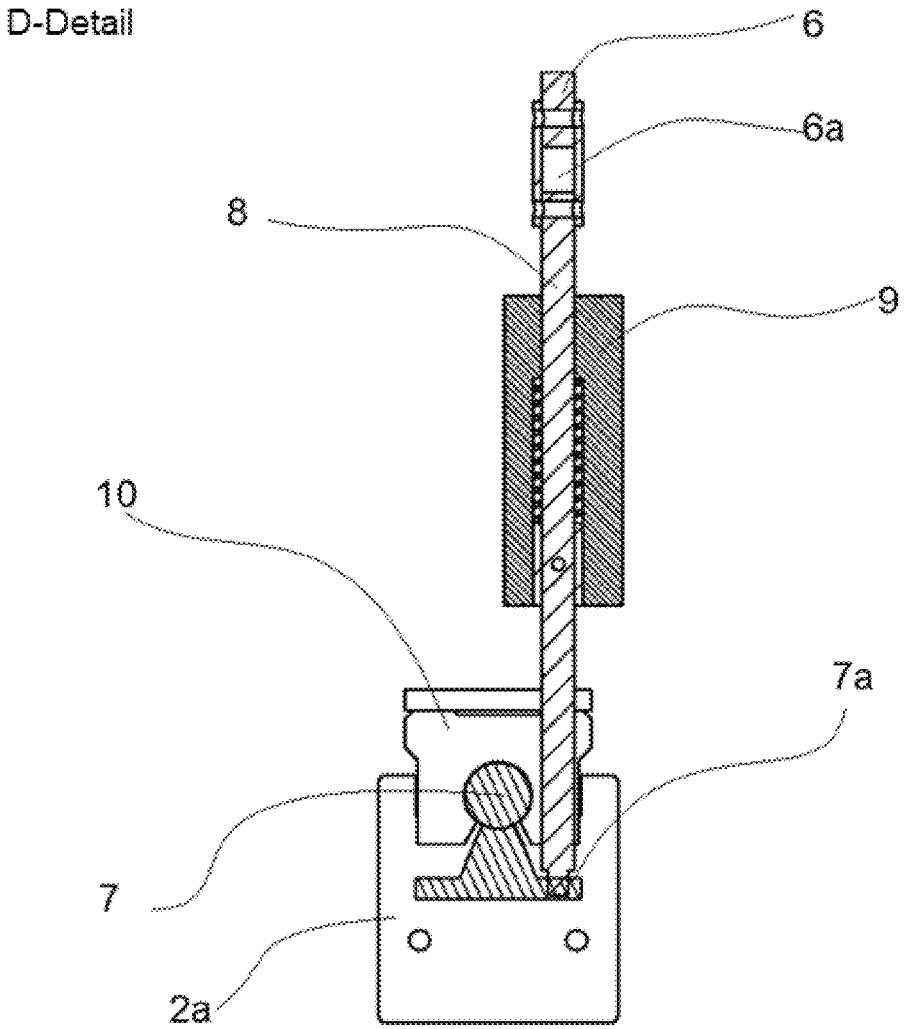
FIG. 13 shows the detailed view of the rigidity (fixing) arrangements in the rail and adjusting mechanism used in said ladder barrel type pilates exercise device of the invention.
Figure 14:
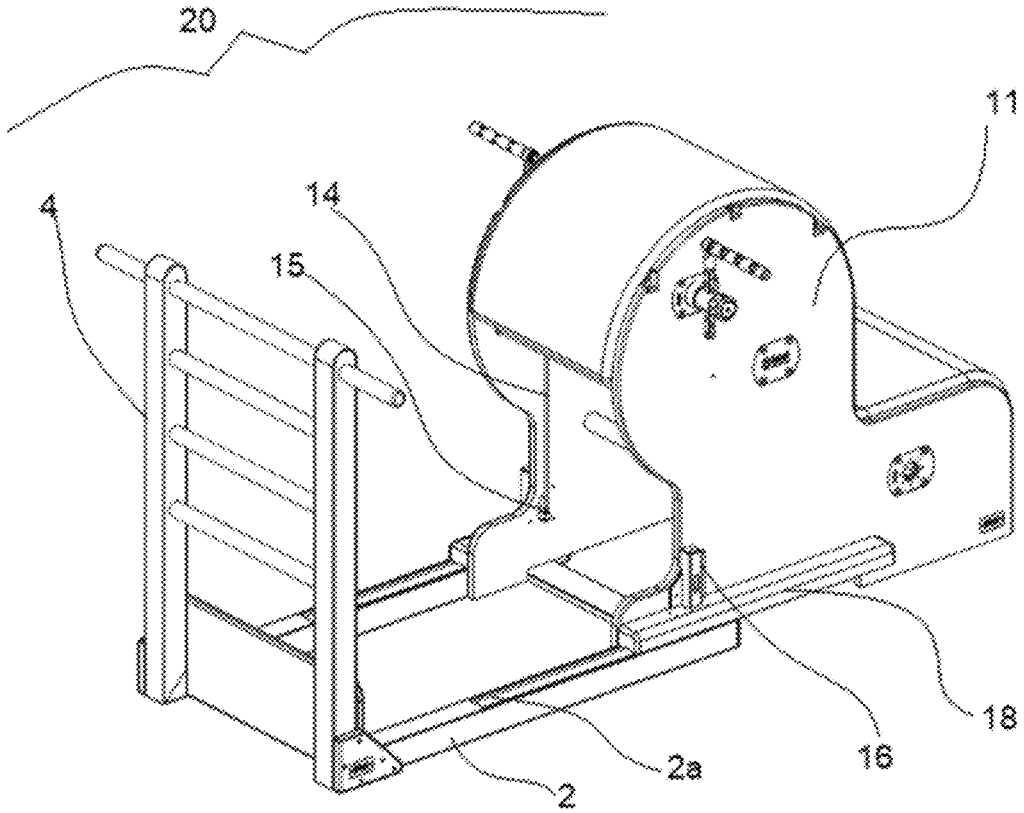
FIG. 14 is the side perspective view of the chair barrel type pilates exercise device of the invention.
Figure 15:
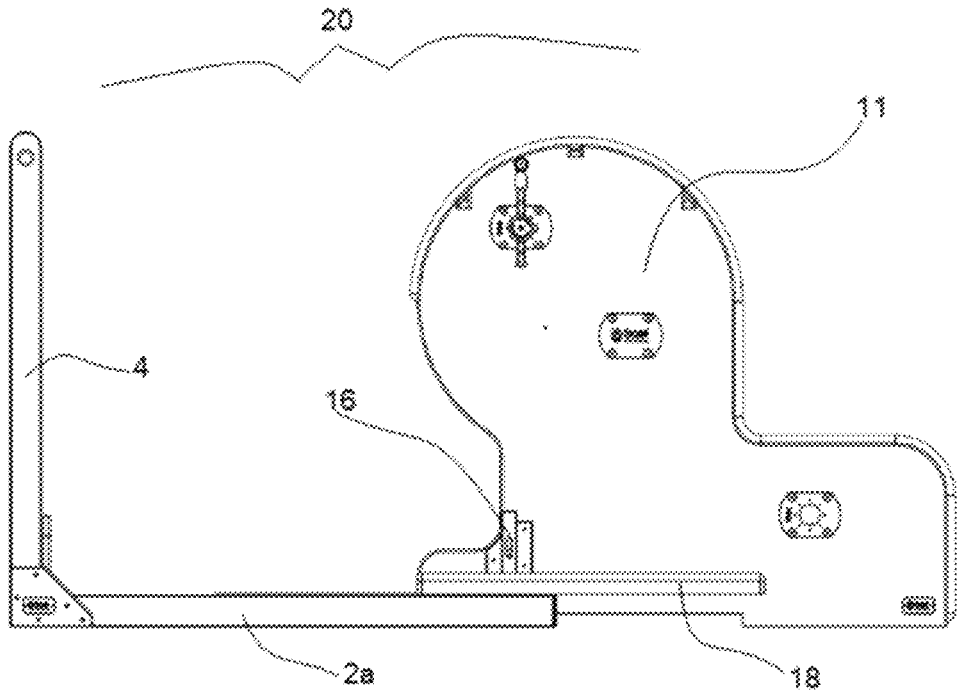
FIG. 15 is the side two dimensional projective view of the chair barrel type pilates exercise device of the invention.
Figure 16:
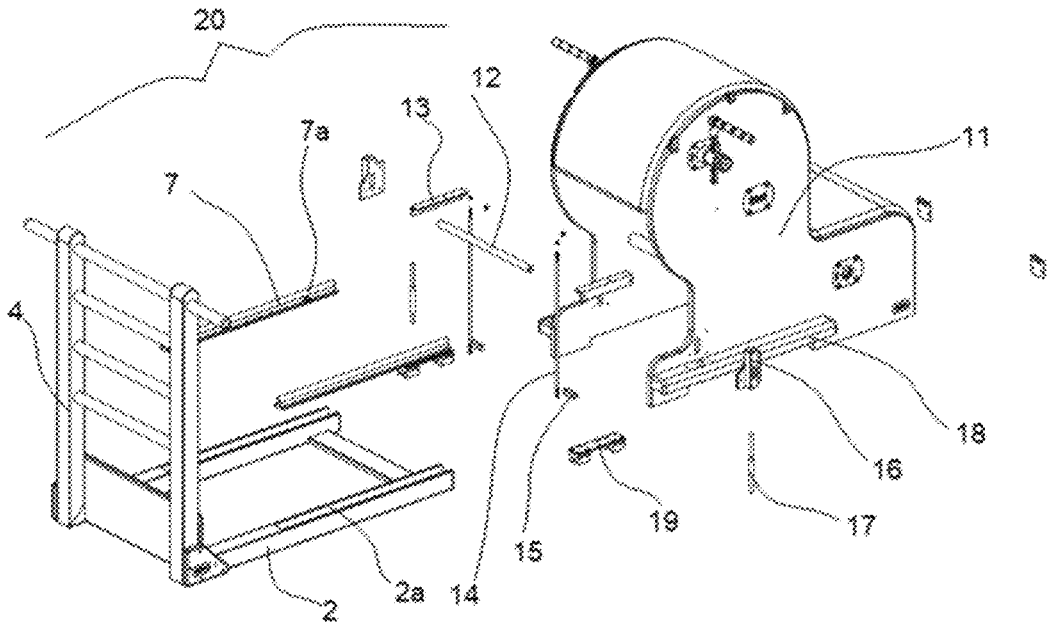
FIG. 16 is the side perspective and exploded view of the chair barrel type pilates exercise device of the invention.
Figure 17:
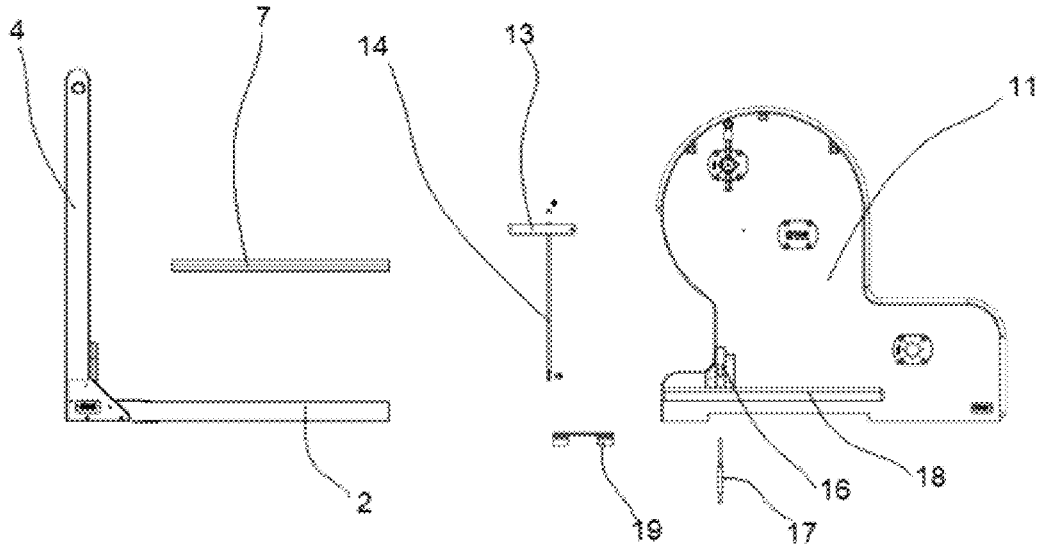
FIG. 17 is an exploded view including the side projective view of the chair barrel type pilates exercise device of the invention.

The exercise device 1 of the invention basically includes a rail carrier body 2, a movable body 3 located in a movable manner with the rail 7 thereon and a fixed body 4 on which the user holds or rests as seen from the assembly and exploded views (in the exploded views) illustrated in FIG. 1, FIG. 2, FIG. 3, FIG. 4 and FIG. 5. In this basic structure, the adjusting mechanism of the invention is illustrated in FIG. 6, FIG. 7, FIG. 8, FIG. 9, FIG. 10 and FIG. 11 together with the rail mechanism. The more detailed view of said adjusting mechanism together with the rail is illustrated in the sectional details of FIG. 12 and FIG. 13 in more detail.

The exercise device of the invention is designed based on the pilates devices known as "ladder barrel" on the market. Accordingly, the exercise device 1 of the invention includes a rail carrier body 2, at least one fixed body 4 in contact with said rail carrier body 2, at least one rail 7 located on said rail carrier body 2, at least one movable body 3 located on said rail 7, at least one adjusting rod 5 located on the upper portion said movable body 3 and at least one transmission bar 6 which is in contact with said adjusting rod 5 and transmits the rotary motion on said adjusting rod 5 to the fixing pin 8 or rail 7.

In the exercise device 1 of the invention, the movable body 3 has a carrier 10 on the lower portion and preferably on the inner side thereof. Preferably, the carrier includes a ball, roller or sliding bearing in order to move the movable body 3 easily via the carrier 10 in a horizontal direction. The carrier 10 is fixedly mounted to the movable body 3. The carrier 10 moves the movable body 3 as well in the horizontal direction by sliding on the rail 7. The movable body 3 may conventionally be moved manually by a user (i.e. with the human hand force) or, if desired, automatically by a motor. The rails 7 are preferably placed in a rail slot 2*a* therefor on the rail carrier body 2. However, if desired, the rail carrier may be located on the rail carrier body 2 without the rail slot 2*a*. The fixed body 4 is preferably fixedly located on the edge portion of the rail carrier body 2 as in the state of the art. The rail 7 preferably has a structure with a narrow, triangular, round profiled, rectangular or pear-profiled upper portion such that it allows an object to advance by sliding thereon or moving with the ball bearings. However, the lower portions, preferably the inner portions of the rail 7 have a wider surface than the rail 7. There are fixing holes 7*a* located at certain intervals on the lower portions of the rail 7. A fixing pin 8 enters the fixing holes 7*a* controlled by adjusting from the above. A stopper 7*b*, limiting the movement of the carrier 10 resides at the terminal and end portion of the rail 7.

A mechanism which is an important detail of the exercise device of the invention and different from the state of the art is an adjusting rod 5. The adjusting rod 5 includes at least one adjusting rod connection 5*a* and at least one bar connection 5*b* parallel therewith and spaced apart therefrom in order to rotate around an axis. The adjusting rod 5 is preferably flat plate-shaped, however, it may have other shapes so as to rotate. The adjusting rod 5 is located on the upper and inner sides of the movable body 3. The fixed rotating hinge-shaped adjusting rod connection 5*a* of the adjusting rod 5 is engaged to the inner, upper and edge portions of the movable body 3. The movement transmission bar 6 is engaged to the bar connection 5*b* portion. The other end of the movement transmission bar 6 includes a connection section and a connection 6*a* is made to one end of the fixing pin 8 by means of this connection 6*a*. The fixing pin 8 is preferably located on the inner edge portion of the movable body 3 via the pin slot 9. Therefore, the movement transmission bar 6 and the fixing pin 8 in contact therewith is able to move more or less linearly. Here, the edge oscillating movements of the fixing pin 8 is prevented by the fixing pin 8 passing through the pin slot 9. Accordingly, the carrier 10 and thus the movable body 3 remain rigid by the fixing pin 8 passing through the fixing hole 7*a* on the lower portion.

In the system of the invention, there is no need to make an adjustment on the lower section by bending down as in the state of the art if it is desired to move and adjust the movable body 3 in the horizontal direction within the exercise device 1. In the system of the invention, because the adjusting rod 5 is supported by the adjusting rod connection 5*a* when the user presses slightly on the adjusting rod 5 it rotates slightly around it. Here, the replaced portion is the bar connection 5*b*. This bar connection 5*b* will move up and down with this motion and accordingly, the movement transmission bar 6 connected thereto and the fixing pin 8 will also move up and down. While moving up, the fixing pin 8 will be released from the fixing hole 7*a* so that the carrier 10 may freely be moved back and forth on the rail. This movement is possible with a slight driving force. Otherwise, the fixing pin 8 will enter the fixing hole 7*a*, thus the carrier 10 and hence the movable body 3 will be fixed (remained rigid).

Figure 18:
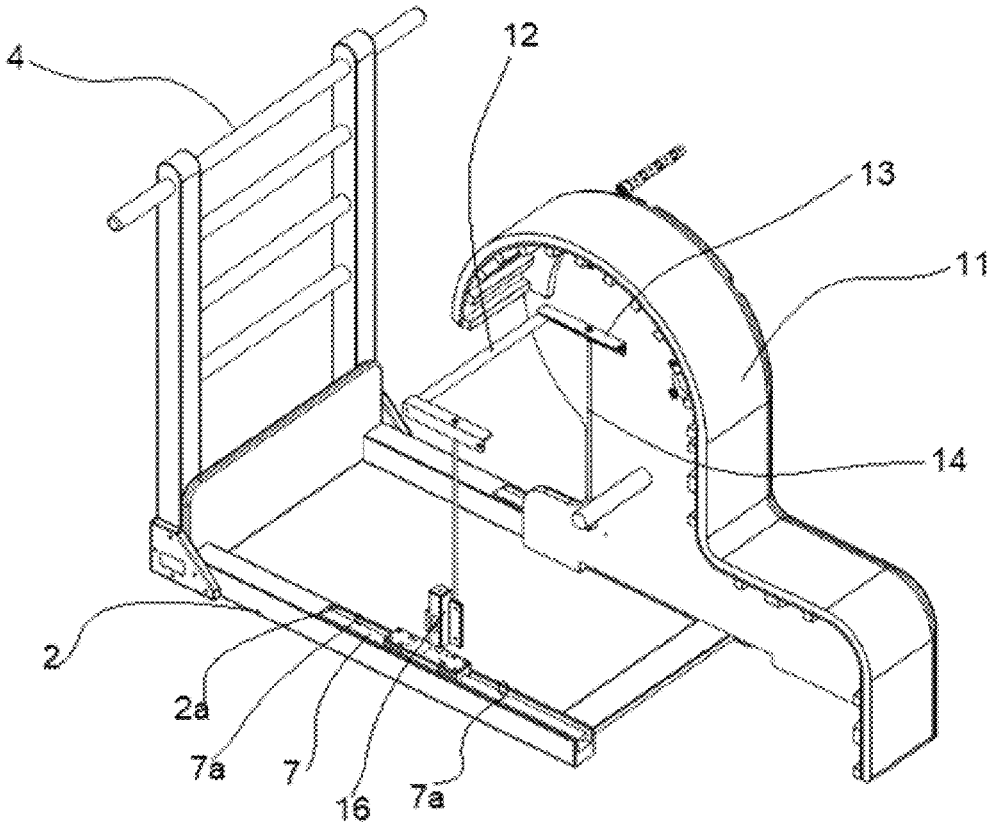
FIG. 18 shows the partial sectional perspective view of the chair barrel type pilates exercise device of the invention.
Figure 19:
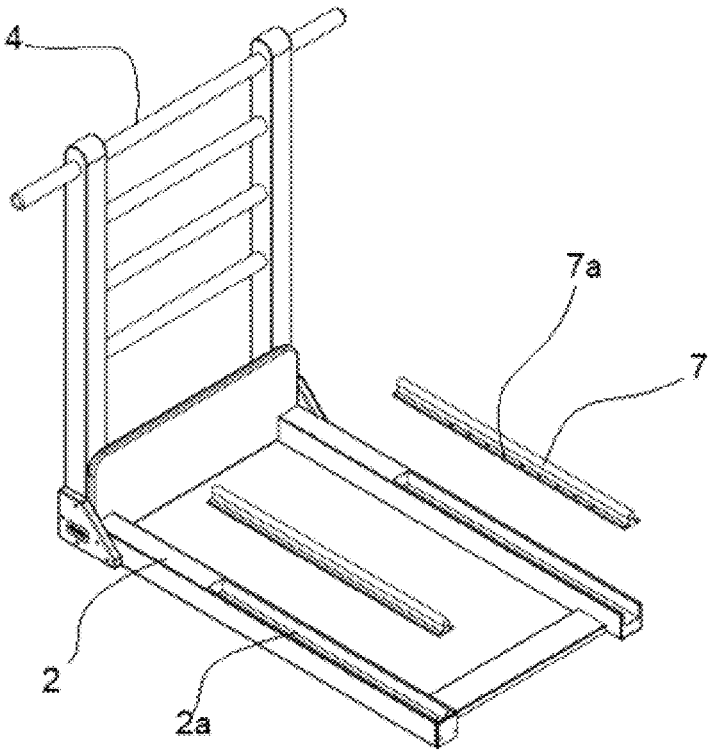
FIG. 19 shows the perspective view of the carrier rail system in the chair barrel type pilates exercise device of the invention.
Figure 20:
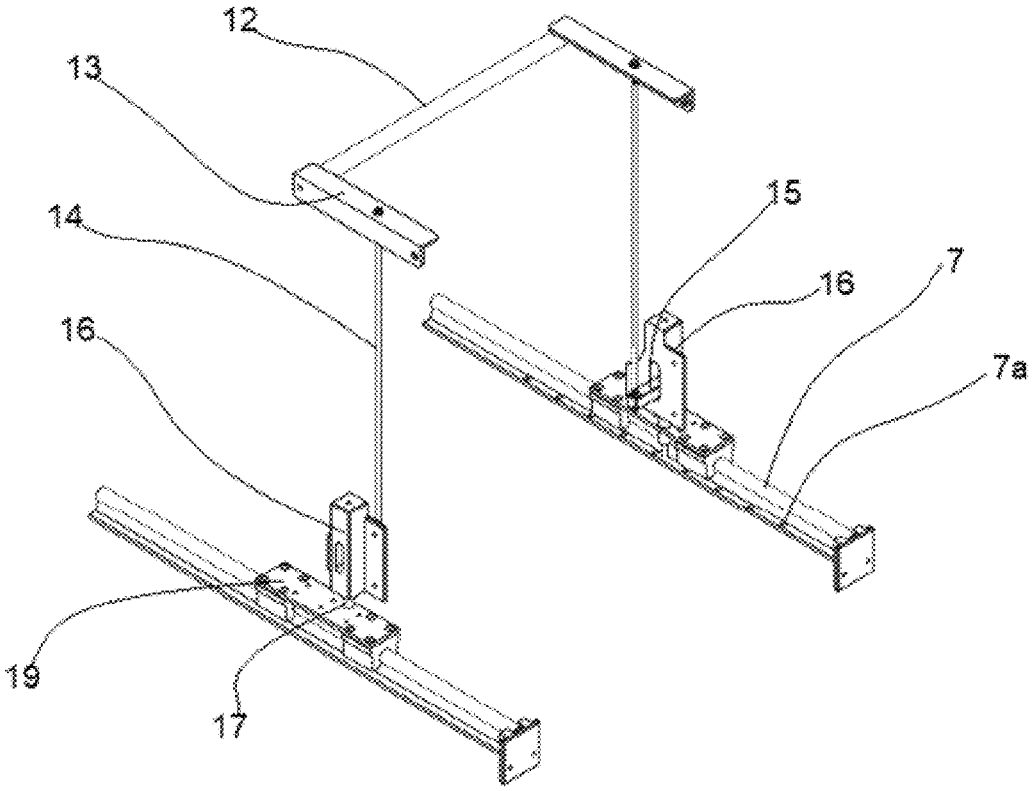
FIG. 20 is the perspective view of the rail and adjusting mechanism used in the chair barrel type pilates exercise device of the invention.
Figure 21:
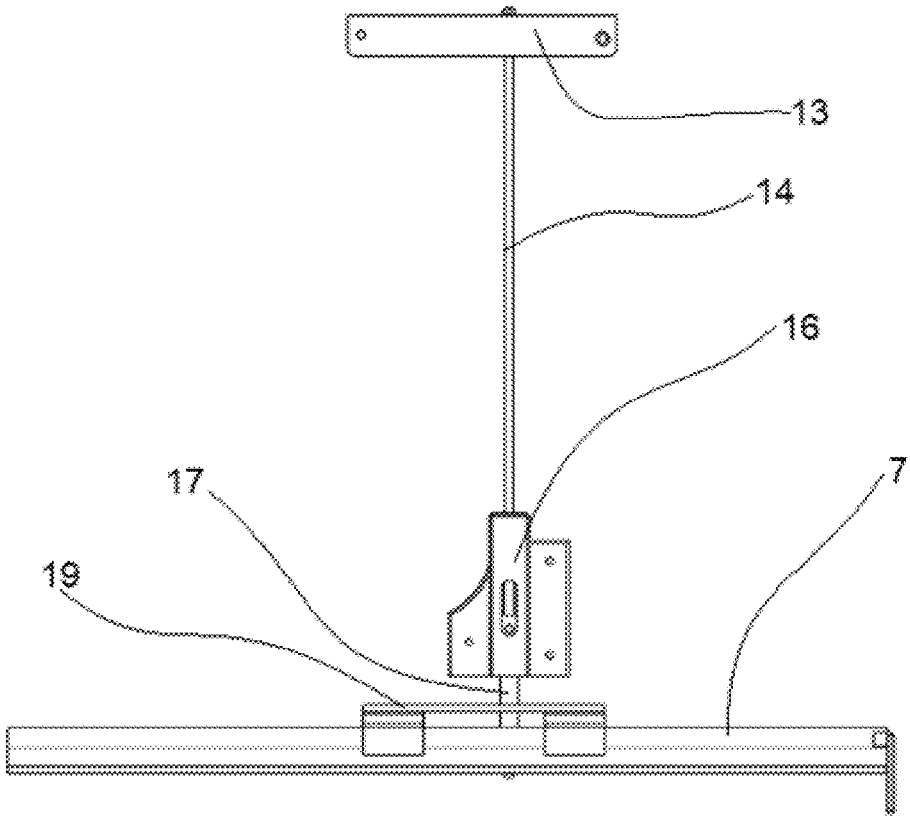
FIG. 21 is the side projective view of the rail and adjusting mechanism used in the chair barrel type pilates exercise device of the invention.
Figure 22:
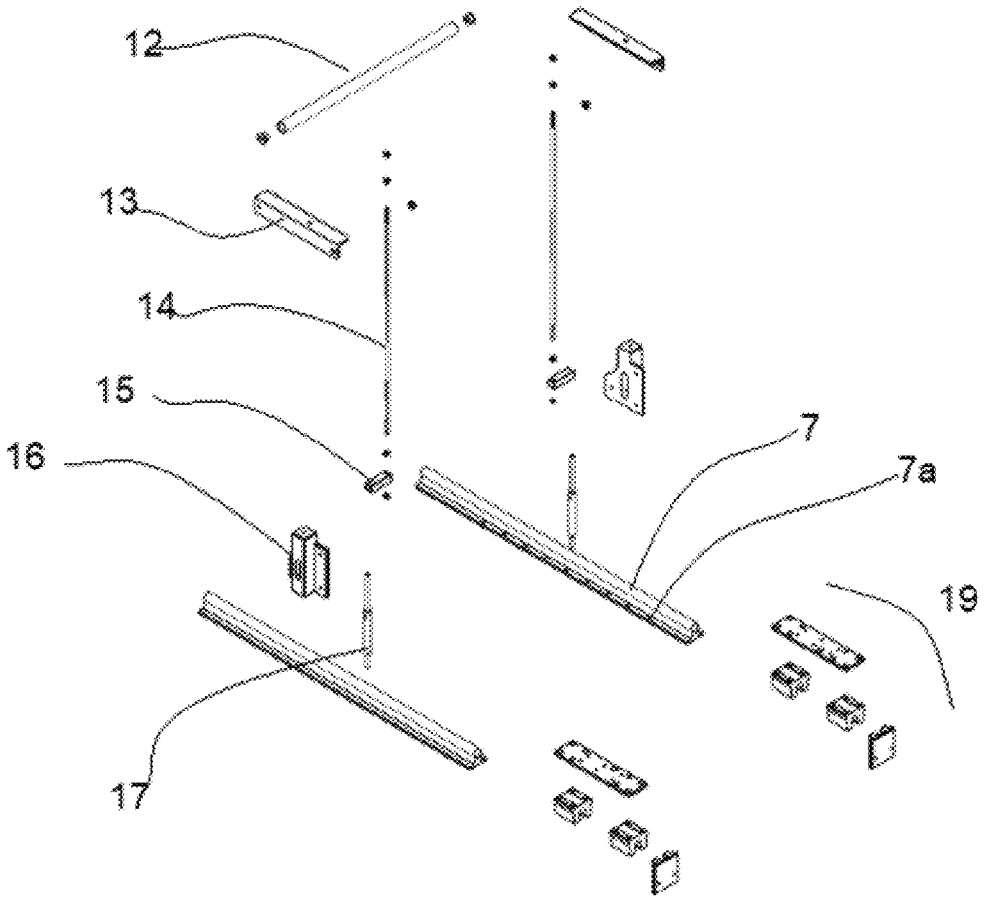
FIG. 22 is the side exploded perspective view of the rail and adjusting mechanism used in the chair barrel type pilates exercise device of the invention.
Figure 23:
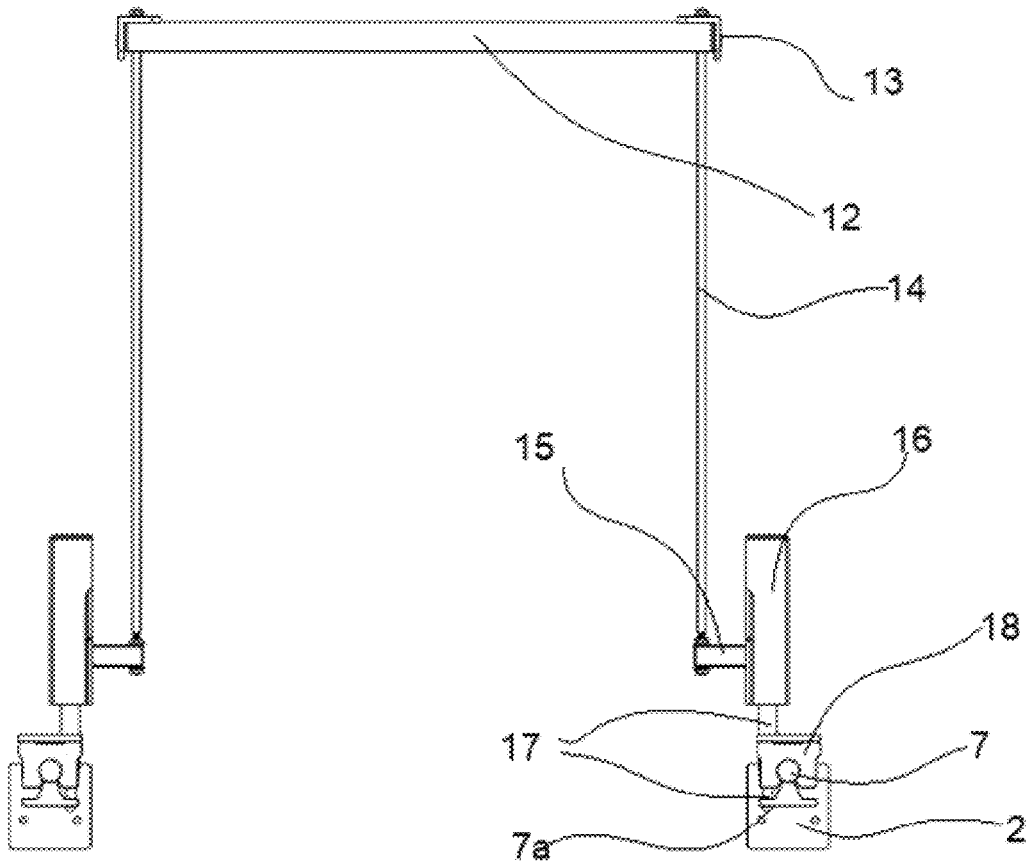
FIG. 23 is the front projective view of the rail and adjusting mechanism used in the chair barrel type pilates exercise device of the invention.
Figure 24:
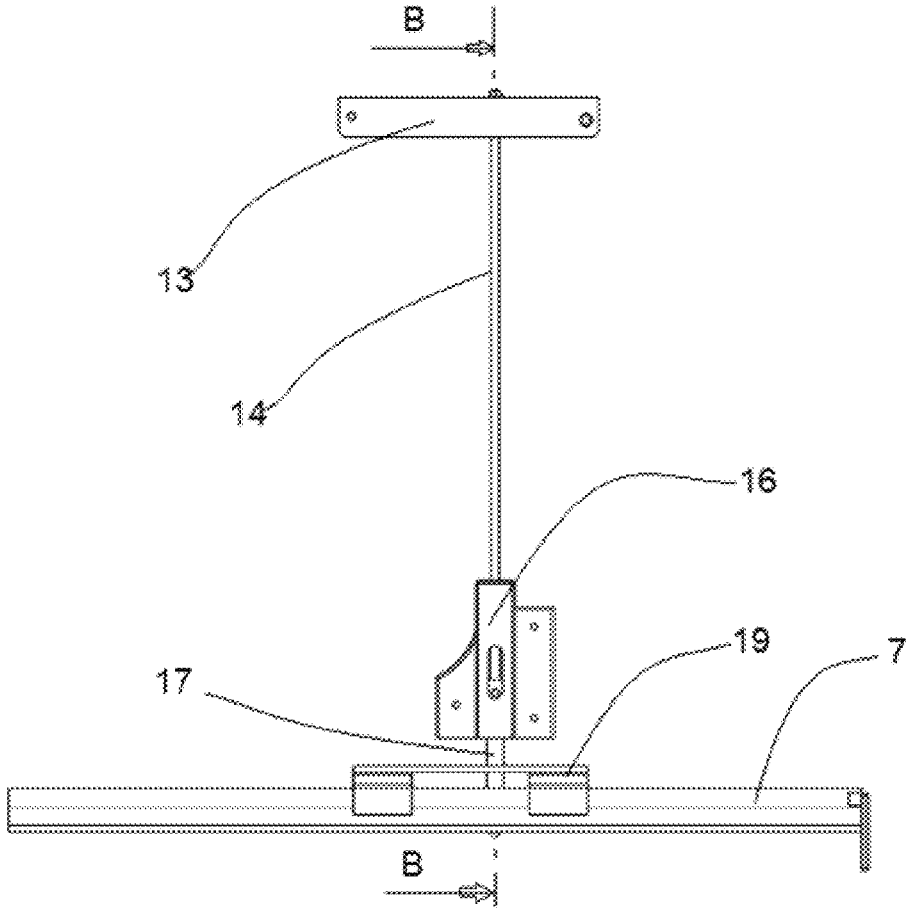
FIG. 24 is the side two dimensional projective view of the rail and adjusting mechanism used in the chair barrel type pilates exercise device of the invention.
Figure 25:
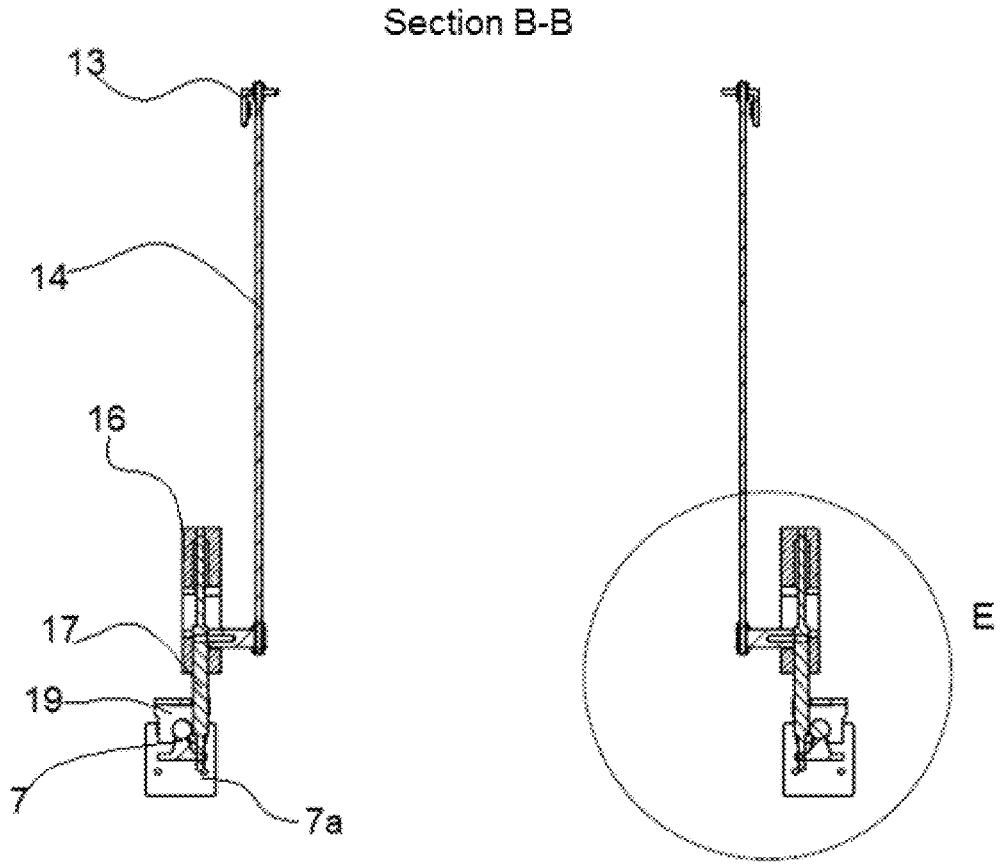
FIG. 25 is the front sectional projective view of the rail and adjusting mechanism used in the chair barrel type pilates exercise device of the invention.
Figure 26:
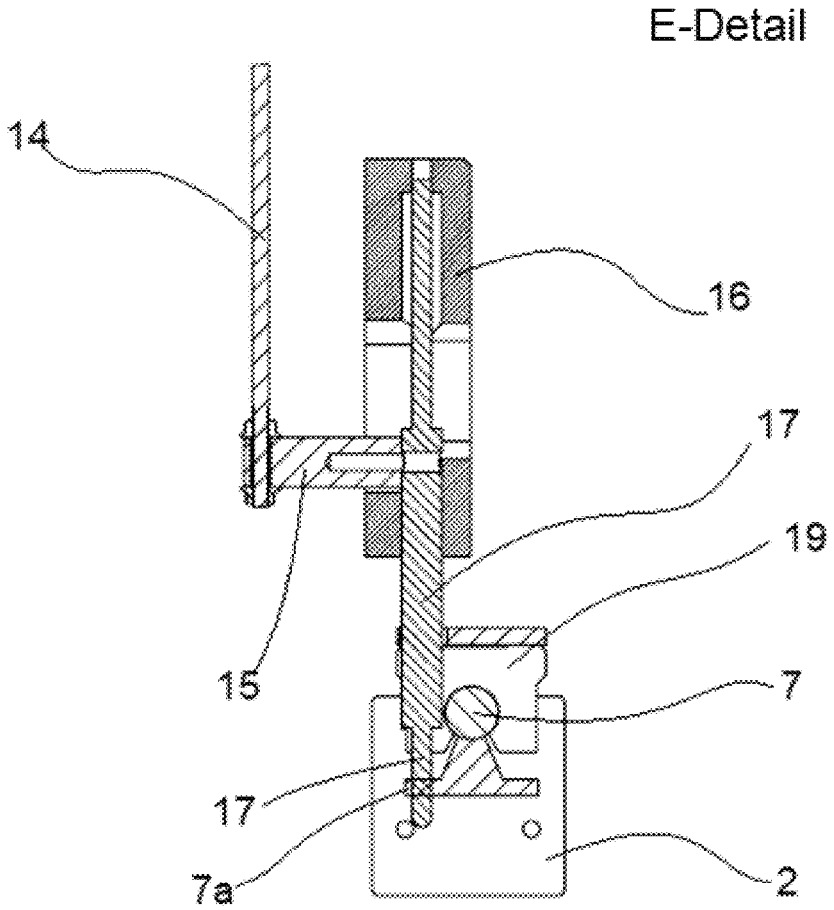
FIG. 26 shows the detailed view of the rigidity (fixing) arrangements in the rail and adjusting mechanism used in the chair barrel type pilates exercise device of the invention.

The construction of the exercise device of the invention changes slightly based on the pilates devices named as "chair barrel" on the market. The "chair" or "chair barrel" structure including a rail structure generally is illustrated in FIG. 14, FIG. 15, FIG. 16 and FIG. 17. In FIG. 18, an exploded view of the structure is illustrated. In FIG. 19, the rail carrier body 2 and the fixed body 4 both used in the exercise device 1 as "ladder barrel" and used in the seated exercise device 20 as "chair barrel" is illustrated in an exploded view. FIG. 20, FIG. 21, FIG. 22, FIG. 23, FIG. 24, FIG. 25 and FIG. 26 are consisted of the views illustrating the adjusting mechanism of the seated exercise device of the invention from different perspectives and the sections.

The exercise device of the invention is designed based on the model thereof which is a type of the pilates devices known as "chair" on the market, which type being used in the rail systems, and may be named as "chair barrel". This model is generally named as the seated exercise device 20. This name is given only for the purpose of describing the construction and should not be binding. Accordingly, the seated exercise device 20 of the invention includes a rail carrier body 2, at least one fixed body 4 in contact with said rail carrier body 2, at least one rail 7 located on said rail carrier body 2, at least one movable assembly 11 located on said rail 7, at least one adjusting press rod 12 located on the upper portion of said movable assembly 11, a deflector 13 which is in contact with said adjusting press rod 12 and reverses the movement, a force transmission bar 14 transmitting the force and the motion in contact with said deflector 13, a side connection 15 which is in contact with said force transmission bar 14 and receives the motion and force therefrom, and a small adjusting pin 17 which is in contact with said side connection 15 and receives the motion and force therefrom. The small adjusting pin 17 transmits the motion and force to the rail 7. That is, it is released when it is on the top, but when it is below it makes the movable assembly 11 rigid (fixed) by sticking into the rail fixing hole 7*a*. The movable assembly 11 is adjusted from the inner and upper portions as in the exercise device 1. However, with the side connection 15 in contact with the force transmission bar 14 used for adjustment, the motion and assembly are transmitted to the rails 7 via the small adjusting pin 17 by transferring to the external side portion of the movable assembly 11. Alternatively, the force and motion are delivered by transmitting to the rails 7 directly from the inner portion with the force transmission bar 14. That is, the required looseness or rigidity may be provided by extending directly up to the rails 7 in the inner portions without the side connection 15 and the small adjusting pin 17 receiving the force.

In the exercise device 20 of the invention, the deflectors 13 are located at the edges on the inner and upper portions of the movable assembly 11. At one end of the deflectors 13, the movable press rod 12 is connected and brings two deflectors 13 into contact. The force transmission bars 14 are brought into contact in the inner portion of the deflector 13. This structure allows the force transmission bar 14 to transmit the motion and force back and forth by pulling up or releasing the adjusting press rod 12 manually. In the seated exercise device 20, it is preferable to provide the motion and adjusting operation on the rail 7 at the external side portions of the movable assembly 11. Therefore, there are side connections 15 performing the transmitting process from the force transmission bar 14 to the side portion, namely to the edges of the movable assembly 11. Hence, the side connection 15 in contact with the force transmission bar 14 and transmitting the motion and force is included in the construction. The small adjusting pin 17 in contact with the side connection 15 is included in order to retransmit the motion and force from the side connection 15 down to the rail 7. The small adjusting pin 17 is brought into contact with the side pin slot 16 located on the side portion of the movable assembly 11. The small adjusting pin 17 is arranged so as to be able to move up and down in contact with the side connection 15 in the side pin slot 16. The side support part 18 located under the side pin slot 16 on the side and lower portions of the movable assembly 11 and in contact with the movable assembly 11 in a rigid manner, and the movable assembly carrier 19 thereunder are included. The structure of the movable assembly carrier 19 is similar with the above-mentioned carrier 10 which is the previous model. A spool, roller, ball or sliding bearing arrangement is included in order to bring contact the movable assembly 11 into the rail carrier body 2 in the movable assembly carrier 19 and to move over the rails 7. It is not preferable to give details as they are known from the state of the art.

In the seated exercise device 20 of the invention, the adjustment created in the movable assembly 11 may, of course, be performed by conveying the force transmission bar 14 directly to the rail 7 as in the exercise device 1 instead of the external side connection 15, the side pin slot 16 and the small adjusting pin 17. This structure may also be regarded as an alternative. Again, instead of the adjusting press rod 12 and deflector 13 in the adjustment at the upper portion, the adjusting rod 5 and the movement transmission bar 6 may also be used as in the exercise device 1. It is possible to use this alternative.

In the seated exercise device 20 of the invention, it is stated above that a ball, roller or sliding bearing is included in the movable assembly carrier 19 at the exterior side (if desired the inner side) of the movable assembly 11 in order to allow the movable assembly 11 to be easily moved in the horizontal direction. The movable assembly carrier 19 is fixedly mounted to the movable assembly 11. The movable assembly carrier 19 also moves the movable assembly 11 in the horizontal direction by sliding on the rail 7. The movable assembly carrier 19 may conventionally be moved with the human hand force or, if desired, by a motor and automatically. The rails 7 are preferably placed in a rail slot 2*a* therefor on the rail carrier body 2. However, if desired, the rail carrier may be located on the rail carrier body 2 without the rail slot 2*a*. The fixed body 4 is preferably fixedly located on the edge portion of the rail carrier body 2 as in the state of the art. The rail 7 preferably has a structure with a narrow, triangle, round profiled, rectangular or pear-profiled top such that it allows an object to advance by sliding thereon or moving with the ball bearings. However, the lower portions, preferably the inner portions of the rail 7 have a wider surface than the rail 7. There are fixing holes 7*a* located at certain intervals on the lower portions of the rail 7. The small adjusting pin 17 enters the fixing holes 7*a* controlled by adjusting from the above. However, if desired, the motion and force may be transmitted to the rail 7 by locating the movable assembly carrier 19 on the inner portion of the movable assembly 11 as stated above and via the force transmission bar 14 acting as a pin. A stopper 7*b*, limiting the movement of the movable assembly carrier 19, is located at the terminal and end portion of the rail 7.

INDUSTRIAL APPLICABILITY

It is possible to basically use the exercise device of the invention in the pilates exercise device, known as "ladder barrel" or "chair barrel", as well as the other exercise devices or other sports and physiotherapy devices.

The general engineering design of the inventive exercise device 1 is intended for the pilates devices, mostly known as "ladder barrel" on the market. Similarly, the design of the seated exercise device 20 is intended for the structures which may be named as "chair barrel" on the market. However, the adjusting mechanisms in both of them may be used interchangeably. That is, the adjusting arrangement on the inner portion of the movable body 3, the movable assembly 11 on the rail, the adjusting mechanism in the movable assembly 11 and positioning arrangements on the rail 7 may also be used in the movable body 3. Even, this adjusting mechanism may not only be used for the "ladder barrel" and "chair barrel" type of the pilates devices, but also all kinds of sports and exercise devices where similar functionality is required.

What is claimed is:

1. An exercise device, at least comprising:
- a rail carrier body;
- a fixed body in contact with the rail carrier body;
- a rail located on the rail carrier body;
- a movable body located on the rail, wherein the movable body has a half cylindrical body upper portion;
- an adjusting rod located on an upper portion of the movable body;
- a movement transmission bar, wherein the movement transmission bar is in contact with the adjusting rod and transmits a rotary motion on the adjusting rod to a fixing pin on the rail; and
- wherein the fixing pin and the movement transmission bar are parallel and vertically aligned.

2. The exercise device according to claim 1, comprising a carrier, wherein the carrier is provided on lower and inner portions of the movable body.

3. The exercise device according to claim 2, comprising a ball bearing, a roller bearing or a sliding bearing, wherein the movable body moves in a horizontal direction within the carrier.

4. The exercise device according to claim 2, wherein the carrier is fixedly mounted to the movable body.

5. The exercise device according to claim 3, wherein the carrier is fixedly mounted to the movable body.

6. The exercise device according to claim 1, wherein a carrier is fixedly mounted to the movable body.

7. The exercise device according to claim 1, wherein the rail is placed in a rail slot on the rail carrier body, or placed on the rail carrier body without the rail slot.

8. The exercise device according to claim 1, wherein the rail has a structure with a narrow, triangular, round profiled, rectangular or pear-profiled top and the rail allows an object to advance by sliding on the rail or moving on the rail with ball bearings.

9. The exercise device according to claim 1, wherein lower portions or inner portions of the rail have a wider surface than the rail, and the rail comprises fixing holes located at intervals on the lower portions of the rail.

10. The exercise device in accordance with the claim 1, wherein the adjusting rod at least comprises an adjusting rod connection and a bar connection, wherein the bar connection is parallel with and spaced apart from the adjusting rod connection in order for the adjusting rod to rotate around an axis.

11. The exercise device according to claim 1, wherein the adjusting rod is located on upper and inner sides of the movable body.

12. The exercise device according to claim 10, wherein the adjusting rod connection of the adjusting rod is of a rotating hinge-shape and engaged to inner, upper and edge portions of the movable body, and the movement transmission bar is engaged to the bar connection.

13. A seated exercise device, at least comprising:

a rail carrier body;

a fixed body in contact with the rail carrier body;

a rail located on the rail carrier body;

a movable assembly located on the rail;

an adjusting press rod located on an upper portion of the movable assembly;

a deflector, wherein the deflector is in contact with the adjusting press rod and reverses a movement of the movable assembly;

a force transmission bar, for transmitting a force and a motion, in contact with the deflector;

a side connection in contact with the force transmission bar and receiving the motion and the force from the force transmission bar;

a small adjusting pin in contact with the side connection and receiving the motion and the force from the side connection; and wherein the adjusting pin and the force transmission bar are parallel and vertically aligned.

14. The seated exercise device according to claim 13, further comprising two deflectors each engaged to edges in inner and upper portions of the movable assembly, wherein the adjusting press rod is movable and is connected to one end of each of the two deflectors.

15. The seated exercise device according to claim 13, wherein the force transmission bar is present in an inner portion of the deflector.

16. The seated exercise device according to claim 13, wherein the small adjusting pin is brought into contact with a side pin slot located on a side portion of the movable assembly, wherein the small adjusting pin is arranged to move up and down in contact with the side connection in the side pin slot.

17. The seated exercise device according to claim 13, wherein a side support part is provided under the side pin slot on side and lower portions of the movable assembly and is in contact with the movable assembly in a rigid manner, and a movable assembly carrier is provided under the movable assembly.

18. The seated exercise device according to claim 13, wherein a movable assembly carrier is fixedly connected to the movable assembly.

19. The seated exercise device according to claim 13, wherein the rail is placed on the rail carrier body, or the rail is placed in a rail slot located on the rail carrier body.

20. The seated exercise device according to claim 13, wherein the rail comprises fixing holes, wherein the small adjusting pin is configured to enter through lower portions of the rail into the fixing holes to allow the movable assembly to be fixed in a horizontal direction.

* * * * *